United States Patent [19]

Hammond

[11] 4,004,360

[45] Jan. 25, 1977

[54] SELF-MASKING X-RAY VIEWING APPARATUS

[76] Inventor: Keith C. Hammond, 3237 W. 35th Ave., Vancouver, British Columbia V6N 2M9, Canada

[22] Filed: July 12, 1974

[21] Appl. No.: 488,161

[52] U.S. Cl. ..... 40/106.1; 40/132 D; 240/2 AT

[51] Int. Cl.[2] ..... G09F 13/10

[58] Field of Search ..... 40/106.1, 132 D, 37, 40/28 C, 31, 130 R, 133 R; 35/1; 240/2 AT; 101/382 MV

[56] References Cited

UNITED STATES PATENTS

| | | | |
|---|---|---|---|
| 2,590,044 | 3/1952 | Schaller | 101/382 MV X |
| 3,391,480 | 7/1968 | O'Keefe | 40/37 X |
| 3,616,554 | 11/1971 | Singer et al. | 40/31 |
| 3,892,080 | 7/1975 | Koch | 40/132 D X |

*Primary Examiner*—Louis G. Mancene
*Assistant Examiner*—John F. Pitrelli
*Attorney, Agent, or Firm*—Fetherstonhaugh & Co.

[57] ABSTRACT

Apparatus having a translucent viewing screen forming a wall of a cabinet and provided with regularly spaced holes extending into the interior of the cabinet. A vacuum pump reduces pressure within the cabinet interior and the resulting pressure differential created at the front face of the screen serves to hold photographic transparencies in position for viewing. The cabinet has lamps arranged to backlight the viewing screen and illuminate the transparencies. An opaque grid is provided between the viewing screen and the lamp and this grid has a chamber in communication with each hole. Each chamber is fitted with a flap-like shutter for controlling the passage of light through the chamber to the screen. The flow of air through those holes which are not covered by the transparency is utilized to close the shutters of the associated chambers thereby effectively masking the areas of the screen surrounding the transparencies.

6 Claims, 6 Drawing Figures

SELF-MASKING X-RAY VIEWING APPARATUS

This invention relates generally to a film viewer and more particularly for apparatus for holding and illuminating x-ray film on the face of a viewing screen while automatically masking areas of the screen around the film.

Medical x-ray films usually are examined by placing them on the viewing screen of a device commonly referred to as an illuminator. Conventional illuminators normally comprise a box-like structure enclosing fluorescent lighting tubes behind a semi-transparent light diffusing viewing screen. Films are retained on the surface of the screen by pushing the upper edge of the film under spring-loaded clips located along the top edge of the viewing screen. Standard size illuminators have viewing screens 17 inches tall and 14 inches or multiples of 14 inches (i.e. 28 inches or 56 inches wide). Such screens are ideal for viewing full size X-ray films which measure 17 inches by 14 inches since each 14 inch width of viewing screen has its own fluorescent tubes and control switch therefor, in which case the sections of the screen not covered by films need not be illuminated. This eliminates unnecessary glare which would impair the vision of the radiologist.

When films smaller than 14 inches by 17 inches are to be examined, they can only be retained on the screen in the same manner as full size films, i.e. by suspending them by means of the spring-loaded clips along the top edge of the viewing screen. This leaves a portion of the screen surrounding the films illuminated and the resulting glare detracts from the visual perception of the person trying to study the film and assess the medical information it contains. A radiologist will find this unwanted light to be particularly distracting when he is required to examine and compare several small films arranged side by side on a screen.

An attempt has been made to solve this masking problem by providing the illuminator with curtains or panels which can be pulled in from the edges of the screen to cut out or block unwanted backlighting. However, use of such manually operated curtains or panels is unsatisfactory since it is not automatic and therefore is time consuming and usually only one film at a time can be examined on each section of the viewing screen.

The present invention overcomes the above described masking problem by providing apparatus which uses a vacuum operated film holder combined with an automatically operating shutter arrangement. The combination dispenses entirely with the spring-loaded clips normally used to secure a film to the screen and a film of any size, when placed and held on the screen by the vacuum developed, actuates the shutter arrangement whereby only the film is illuminated while the remainder of the screen is blacked out.

In order to achieve the foregoing holding, illuminating and masking action; the present invention contemplates apparatus provided with a light diffusing viewing screen having front and rear faces, said viewing screen being provided with a plurality of spaced air inlet holes extending therethrough between the front and rear faces, a grid alongside the rear face forming a network of light-confining and air-conducting chambers one in communication with each air inlet hole, suction means connected to the chambers to cause a flow of air through each air inlet hole and communicating chamber, light means near the grid for directing light through the chambers to the viewing screen, and shutter means associated with each chamber normally supported in a light-blocking position by air flowing through said chamber, said X-ray film when placed on the front face of the viewing screen to be held thereon by atmospheric pressure blocking those air-inlet holes within the boarders of said film whereby only the shutter means in the chambers behind the blocked air inlet holes move to light admitting positions.

In drawings which illustrate preferred embodiments of the invention,

Figure 1:
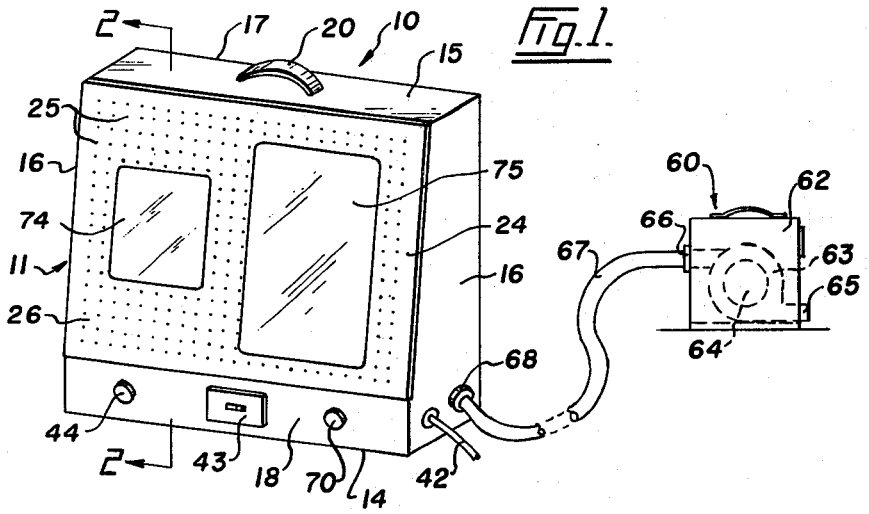
FIG. 1 is a perspective view of a preferred form of the present apparatus.

Referring to the drawings, the numeral 10 indicates self-masking X-ray film viewing apparatus which constructed as a portable cabinet 11 so that it can readily be moved about a hospital or elsewhere.

The cabinet 11 is an oblong structure having bottom, top, side and rear walls 14 to 17. A panel 18 is supported by the bottom wall 14 and this panel is aligned with a flange 19 carried by the top wall 15, which top wall desirably is fitted with a carrying handle 20.

Suitably secured to the panel 18 and flange 19, as well as to the side wall 16 of the cabinet, is a viewing screen 24. This screen 24 preferably is a semi-transparent white acrylic plastic of a suitable thickness (approximately 6.3 m.m.) to obscure the several components mounted within the cabinet. A very large number of small diameter holes 25 (0.8 m.m. or less) are formed in the light-diffusing screen 24 and these holes are regularly spaced apart to cover the entire surface of the screen except for a narrow border on all four sides. As indicated in FIG. 1, the holes 25 form a square pattern with each hole preferably being spaced apart 12.7 m.m. from adjacent holes on opposite corners of the square. The minute holes 25 extend between the smooth and parallel front and rear faces 26 and 27 of the screen so that the plastic material is pervious to air although the holes are scarcely noticeable because of their very small diameters. The cabinet 11 is otherwise made as airtight as possible for reasons which will be made apparent later.

Figure 3:
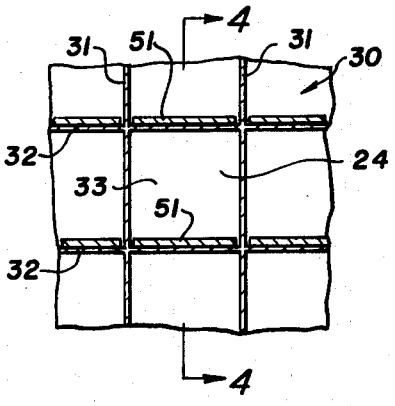
FIG. 3 is an enlarged vertical section taken on the line 3—3 of FIG. 2.

The apparatus 10 is provided with a grid generally indicated at 30 which is suitably supported within the cabinet to bear against the rear face 27 of the screen between the panel 18 and flange 19. Grid 30 is a honeycomb-like structure having vertical walls 31 and horizontal walls 32 both formed of an opaque material and which define chambers 33 which are square in cross-section as shown in FIG. 3. There is one chamber 33 for each hole 25 and the arrangement is such that air flowing through that hole is confined between the walls 31 and 32 of the adjacent chamber. The rear face of the grid 30 is covered by a vertically disposed plate 37 which is formed of a suitable transparent material, this rear plate having an air outlet hole 38 for each chamber 33.

Figure 2:
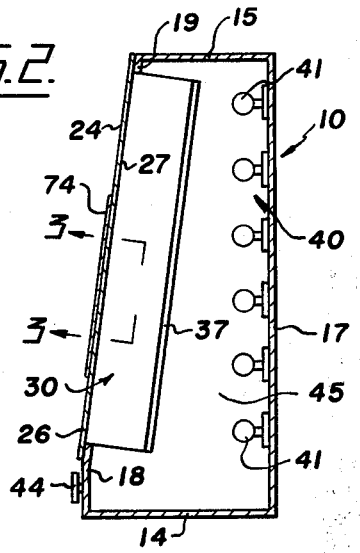
FIG. 2 is a vertical section taken on the line 2—2 of FIG. 1.

The apparatus has lighting means generally indicated at 40 and which is shown in FIG. 2 to comprise a number of fluorescent lighting tubes 41 which are mounted on the rear wall 17 of the cabinet opposite the grid 30. These horizontally disposed and vertically spaced tubes 41 are adapted to be connected to a source (not shown) of electric power by a conventional circuit which includes lead-in wires 42 and an on-off switch 43, see FIG. 1. The wires 42 are shown extending into the cabinet through right side walls 16 (FIG. 1) while the control switch 43 is conveniently mounted on the center of the front panel 18. Preferably, the circuit for the lamps 41 would also include a rheostat 44 mounted on the front panel 18 whereby the amount of light could be varied as required. When the tubes 41 are energized, interior 45 of the cabinet is illuminated but the several cabinet walls are opaque and therefore the light rays are contained and must travel forwardly through the transparent rear plate 37 and the chambers 33 to backlight the translucent viewing screen 24.

Figure 4:
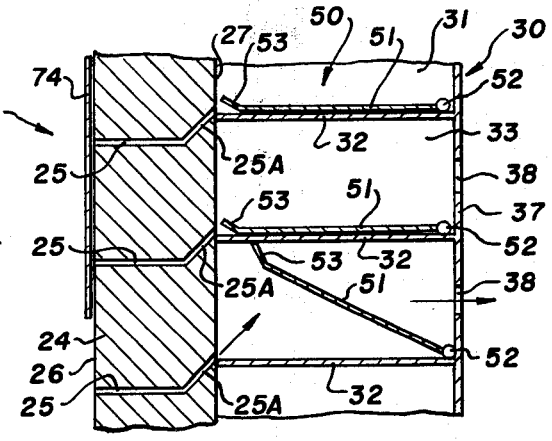
FIG. 4 is a vertical section taken on the line 4—4 of FIG. 3.

Apparatus 10 has shutter means generally indicated at 50 for controlling the backlighting of the screen 24 and, in FIGS. 3 and 4, this means is shown to comprise flaps 51 which are mounted one in each of the chambers 33. Each flap 51 is formed of a rectangular sheet of thin, lightweight and opague material having a width only slightly less than the spacing between the vertical walls 31 of the chamber. The flap 51 is provided with a weighted bead 52 on the rear edge thereof and this bead is adapted to pivot about the junction formed by the adjacent bottom wall 32 and rear plate 37. The opposite or front edge of the flap 51 is upwardly inclined as at 53 whereby to extend over the inner end of the hole 25 connected with that particular chamber 33. In FIG. 4, it will be noticed the holes 25 are not entirely horizontal but have upwardly turned inner ends 25A and it is these ends which at times are partially blocked by the inclined front edges 53 of the shutters.

The flaps 51 normally lie substantially flat on the bottom horizontal walls 32 of the chambers as shown best in the two upper chambers illustrated in FIG. 4 and this, of course, is the open position of the shutter means and light from the lamps 41 is then free to reach the plate 24 while being confined or collimated by the opague walls 31 and 32 of the chambers. The closed position of the flaps 51 is shown by the lowermost shutter in FIG. 4 at which time it angles upwardly across the chamber 33 to block the passage of light reaching that portion of the rear face 27 of the screen which is bordered by the chamber walls 31 and 32. In order for flaps 51 to be moved to and be supported in the closed or light-blocking position, air must be induced into the chamber 33 through the connecting hole 25 and this is brought about by suction means generally indicated at 60.

The means 60, which is shown in FIG. 1 only, comprises a vacuum unit 62 having a pump 63 which is driven by an electric motor 64. The pump 63 has an outlet 65 and an inlet 66 which is connected by a long length of hose 67 to a tubular fitting 68 extending through right side wall 16 (FIG. 1) of the cabinet. This arrangement allows the unit 62 to be located some distance away from the cabinet whereupon the apparatus can be used without interference by noise or vibration. The circuit to the electric motor 64 is provided with a rheostat 70 which is mounted on the front panel 18 of the cabinet and the reason for this variable switch element will now be explained.

To operate the apparatus 10, the lamps 41 and motor 64 are energized and the speed of the motor is adjusted by use of the rheostat 70 to bring about a suitable reduction of pressure within the cabinet 11. This causes air to be drawn through the restricted inlet holes 25. As streams of air flow through the 25, they impinge on the upturned front edges 53 of the flaps and cause said flaps to pivot about the weighted beads 52 to their closed positions. This closing of all the flaps 51 serves to darken the entire screen which remains in darkness until the radiologist is ready to view an X-ray film or films.

In FIG. 1, the numerals 74 and 75 indicate films of varying sizes which the radiologist may want to view and these are attached to the screen 24 simply by placing them into contact with the front face 26 where they are held by atmospheric pressure. Since each film blocks a group of the air inlet holes 25, the flaps 51 in the chambers immediately behind those blocked holes drop to the open position and this allows light to reach the back of the screen thus illuminating the films. The remaining flaps 51 remain closed so that the areas on the screen around the two films remain in darkness or, in other words, are automatically masked so that the radiologist's visual perception is not impaired by unnecessary light around the films.

Figure 5:
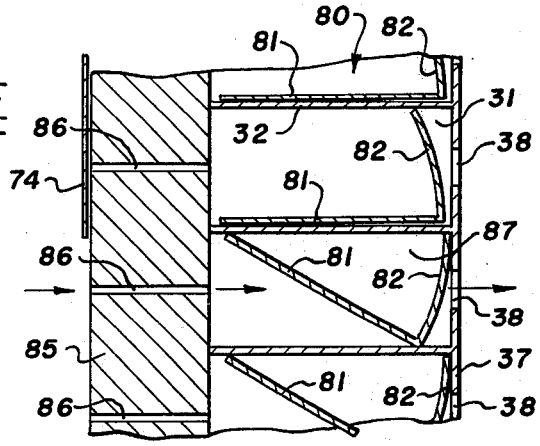
FIG. 5 is a vertical section similar to FIG. 4 but showing another embodiment of the invention.

Referring now to FIG. 5, a modified shutter means is generally indicated at 80 and is shown to comprise a flat, rectangular and opague flap 81 having a curved and transparent rear flange 82. Screen 85 has holes 86 which are centrally disposed with respect to their chambers 87 and are horizontal throughout their lengths. Air flowing into the cabinet through the holes 86 initially will strike the flanges 82 to start the pivoting movement of the flaps which are then held in their closed or light-blocking positions by the difference in air pressure between opposite faces thereof. Shutter means 80 has been found to give a fast and positive opening and closing action.

Figure 6:
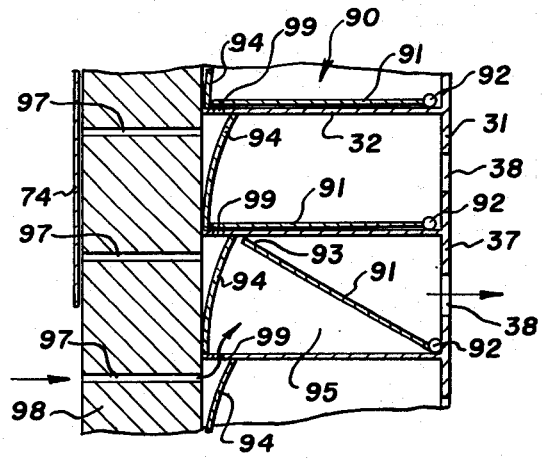
FIG. 6 is a vertical section also similar to FIG. 4 and showing still another embodiment of the invention.

FIG. 6 shows still another embodiment of the invention which has shutter means generally indicated at 90. The means 90 comprises a rectangular flap 91 having a weighted bead 92 extending along near one edge and a plain opposite edge 93 near a curved window 94 which is fixed within the chamber 95 to extend between the four walls thereof. Holes 97 which are horizontal are provided in the screen 98 to connect in front of the windows with openings 99 in the bottom walls of the chambers. The windows 94 closely fit and are swept by the front edges 93 of the flaps as said flaps pivot between their light-blocking and light-admitting positions. Thus, the flaps 91 are more closely confined within their chambers than before and therefore react more quickly to an influx of air into the chambers as a result of the vacuum developed by the unit 62 and to the blockage of that air incidental to the placing of an X-ray film on the front face of the viewing screen.

From the foregoing, it will be apparent that each of the three embodiments of the invention will hold a film on the face of a viewing screen and will mask surrounding areas of the screen in a manner which distinguishes the present apparatus from other X-ray viewers. The automatic self-masking action can be halted, as might be desirable under certain circumstances, by use of the rheostat 70. This switch 70 enables the output from the vacuum unit 62 to be reduced to a point which maintains the film retaining properties of the screen without operating the shutter means. Less suction is required to hold a film in place on the screen than is needed to pivot the flaps to light-blocking positions and therefore this selective use of the self-masking action is possible.

I claim:

1. Apparatus for holding and illuminating an X-ray film comprising a light diffusing viewing screen having front and rear faces, said viewing screen being provided with a plurality of spaced air inlet holes extending therethrough between the front and rear faces, a grid alongside the rear face forming a network of light-confining and air-conducting chambers one in communication with each air inlet hole, suction means connected to the chambers to cause a flow of air through each air inlet hole and communicating chamber, lighting means near the grid for directing light through the chambers to the viewing screen, and shutter means associated with each chamber having means thereon which cooperates with air flowing in said chamber so that said shutter is normally supported in a light-blocking position, said X-ray film when placed on the front face of the viewing screen to be held thereon by atmospheric pressure blocking those air inlet holes within the borders of said film whereby only the shutter means in the chambers behind the blocked air inlet holes move to light-admitting positions.

2. Apparatus as claimed in claim 1, and including control means for the vacuum means, said control means allowing the air flow through the chamber to be reduced to a value whereby all shutter means remain in light-admitting positions.

3. Apparatus as claimed in claim 1, in which said shutter means each comprises a flap freely mounted in a chamber, said flap having a rear edge weighted to act as a pivot point and an upturned front edge projecting over an adjacent air inlet hole when the shutter means is in the light-admitting position.

4. Apparatus as claimed in claim 1, in which said shutter means each comprises a flap freely mounted in each chamber, said flap having a rear edge acting as a pivot point and a curved transparent flange projecting above said rear edge, said transparent flange being disposed in the path of air flowing through the chamber whereby to initiate pivotal movement of the flap to dispose the shutter means in light-blocking position.

5. Apparatus as claimed in claim 1, in which said shutter means each comprises a flap freely mounted in a chamber, said flap having a rear edge weighted to act as a pivot point and a front edge, said air inlet holes each communicating with their chambers through an opening formed in a wall of said chamber beneath the front edge of the flap, and a window extending across each chamber near the front edge of the flap to separate the opening of that chamber from the air inlet hole of an adjacent chamber.

6. Apparatus for holding and illuminating an X-ray film comprising a cabinet, a light diffusing viewing screen forming a wall of the cabinet and having front and rear faces, said viewing screen being provided with a plurality of spaced air inlet holes extending therethrough between the front and rear faces, a grid alongside the rear face forming a network of light-confining and air-conducting chambers one in communication with each air inlet hole, suction means connected to the cabinet to partially evacuate the interior thereof and cause a flow of air through each air inlet hole and communicating chamber, light means within the cabinet behind the grid for directing light through the chambers to the viewing screen, and shutter means associated with each chamber having means thereon which cooperates with air flowing in said chamber so that said shutter is normally supported in a light-blocking position, said X-ray film when placed on the front face of the viewing screen to be held thereon by atmospheric pressure blocking those air inlet holes within the borders of said film whereby only the shutter means in the chambers behind the blocked air inlet holes move to light-admitting position, and control means for regulating the vacuum means.

* * * * *